US010350912B1

(12) United States Patent
Herrmann et al.

(10) Patent No.: US 10,350,912 B1
(45) Date of Patent: Jul. 16, 2019

(54) PRINTER AND DRYER FOR DRYING IMAGES ON COATED SUBSTRATES IN AQUEOUS INK PRINTERS

(71) Applicant: Xerox Corporation, Norwalk, CT (US)

(72) Inventors: Douglas K. Herrmann, Webster, NY (US); Chu-Heng Liu, Penfield, NY (US); Paul J. McConville, Webster, NY (US); Seemit Praharaj, Webster, NY (US); Jason M. LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/934,257

(22) Filed: Mar. 23, 2018

(51) Int. Cl.
*B41J 11/00* (2006.01)
*B41J 13/10* (2006.01)

(52) U.S. Cl.
CPC ..... *B41J 11/002* (2013.01); *B41J 13/10* (2013.01)

(58) Field of Classification Search
CPC ..... B41J 11/002; B41J 13/10
See application file for complete search history.

(56) References Cited

U.S. PATENT DOCUMENTS

| | | | | |
|---|---|---|---|---|
| 5,371,531 | A | 12/1994 | Rezanka et al. | |
| 6,076,921 | A | 6/2000 | Rezanka et al. | |
| 6,132,038 | A | 10/2000 | Szlucha | |
| 6,238,046 | B1 * | 5/2001 | Donahue | B41J 11/002 347/102 |
| 6,428,160 | B2 | 8/2002 | Roy et al. | |
| 6,799,759 | B1 | 10/2004 | McNamara et al. | |

* cited by examiner

*Primary Examiner* — Bradley W Thies
(74) *Attorney, Agent, or Firm* — Maginot Moore & Beck LLP

(57) ABSTRACT

An aqueous ink printer includes a dryer that enables coated substrates printed with aqueous ink images to be adequately dried before discharge of the substrates. The dryer is configured to hang the substrates vertically without the substrates touching one another as heat is applied to the substrates within the dryer to reduce the footprint of the dryer and increase the exposure time of the substrates to heat produced by the dryer.

23 Claims, 5 Drawing Sheets

PRINTER AND DRYER FOR DRYING IMAGES ON COATED SUBSTRATES IN AQUEOUS INK PRINTERS

TECHNICAL FIELD

This disclosure relates generally to aqueous ink printing systems, and more particularly, to drying systems in such printers.

BACKGROUND

Known aqueous ink printing systems print images on uncoated substrates. Whether an image is printed directly onto a substrate or transferred from a blanket configured about an intermediate transfer member, once the image is on the substrate, the water and other solvents in the ink must be substantially removed to fix the image to the substrate. A dryer is typically positioned after the transfer of the image from the blanket or after the image has been printed on the substrate for removal of the water and solvents. To enable relatively high speed operation of the printer, the dryer heats the substrate and ink to temperatures that typically reach 100° C. Uncoated substrates generally require exposure to the high temperatures generated by the dryer for a relatively brief period of time, such as 500 to 750 msec, for effective removal of the liquids from the surfaces of the substrates.

Coated substrates are desired for aqueous ink images. The coated substrates are typically used for high quality image brochures and magazine covers. These coated substrates, however, exacerbate the challenges involved with removing water from the ink images as an insufficient amount of water and solvents is removed from the ink image by currently known dryers. One approach to addressing the inadequacy of known dryers is to add one or more uniformly drying stages after the first dryer that repeat the uniform drying performed by the first dryer. This approach suffers from a substantial lengthening of the footprint of the printer and an increase in the energy consumed by the printer from the addition of the other uniform drying stages. Also, adding uniform drying stages to an aqueous ink printing system increases the complexity of the system and can impact reliability of the system. Another approach is to increase the temperature generated by a uniform drying stage; however, an upper limit exists for the temperature generated by the uniform drying stage. At some point, the temperature can reach a level that degrades some substrates or the higher temperature of the substrates can result in the output stack of substrates retaining too much heat for comfortable retrieval of the printed documents. Developing drying devices and methods that enable ink images on coated papers to be efficiently processed without significantly increasing the time for processing the images, the footprint of the printer, the complexity of the printing system, or the temperatures to which the substrates are raised would be beneficial.

SUMMARY

A new aqueous ink printing system includes a drying system that enables efficient drying of aqueous ink images without appreciable additional complexity or significant increases in drying temperatures. The printing system includes at least one printhead configured to eject drops of an aqueous ink onto substrates moving past the at least one printhead to form ink images on the substrates, and a dryer configured to hang the substrates vertically without the hanging substrates touching one another as heat is applied to the substrates within the dryer.

A new dryer enables efficient drying of aqueous ink images without appreciable additional complexity or significant increases in drying temperatures. The dryer includes a housing, a track located within the housing, a plurality of grippers positioned along the track and the plurality of grippers being configured to move along the track, each gripper being configured to capture at a first predetermined position on the track a portion of a substrate bearing an ink image in an area outside of the ink image on the substrate and to release the substrate at a second predetermined position on the track, the track and the grippers being further configured to hang the substrates held by the grippers vertically within the housing without the hanging substrates touching one another, and a heater configured to generate heat within the housing to dry the hanging substrates held by the grippers as the grippers move along the track.

BRIEF DESCRIPTION OF THE DRAWINGS

The foregoing aspects and other features of an aqueous ink printing system that includes a drying system that enables efficient drying of aqueous ink images without appreciable additional complexity or significant increases in drying temperatures are explained in the following description, taken in connection with the accompanying drawings.

DETAILED DESCRIPTION

Figure 1:
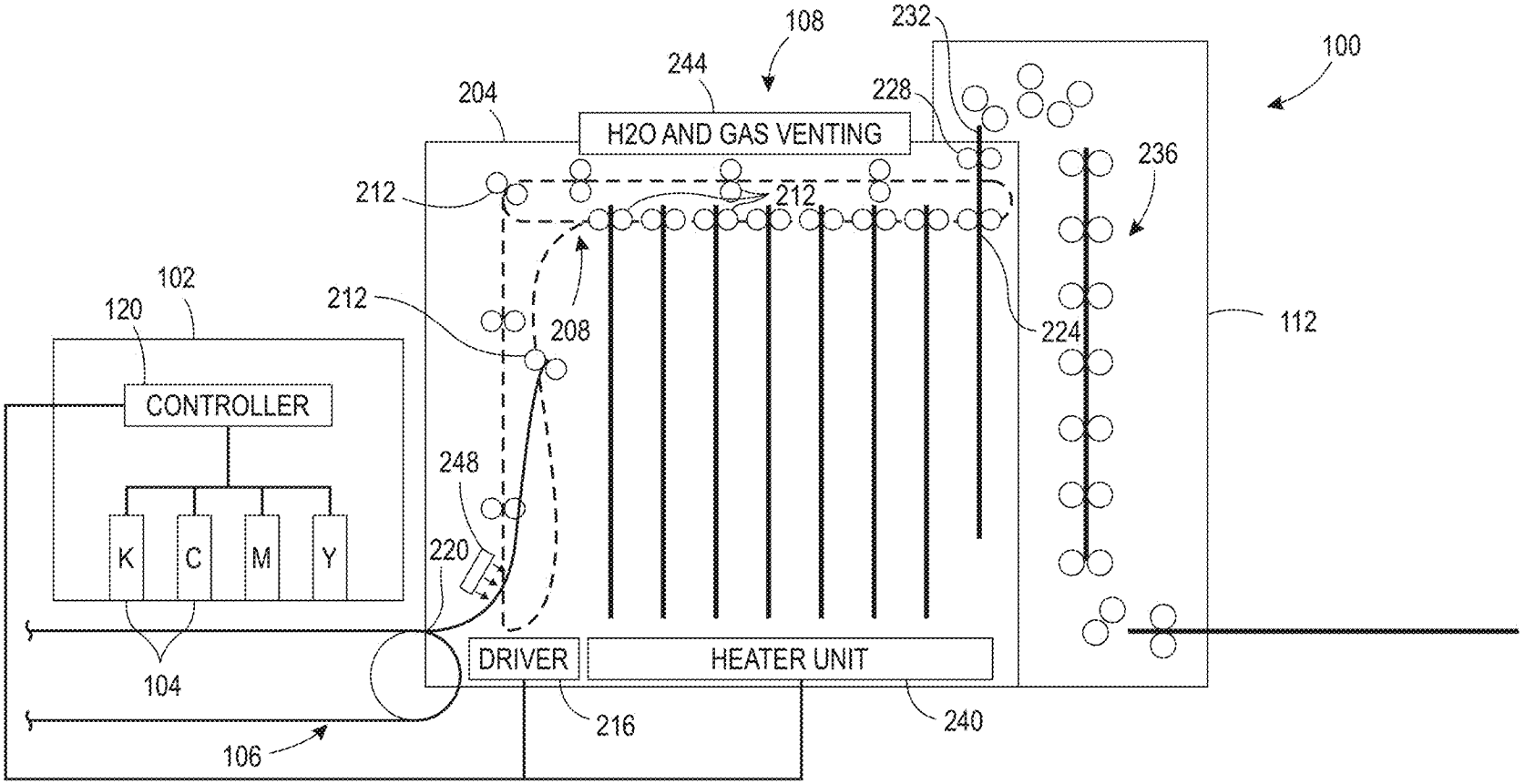
FIG. 1 is a schematic diagram of an aqueous ink printing system that increases the dwell time that printed substrates are exposed to heat without slowing the processing of the printed substrates within the printer.

For a general understanding of the present embodiments, reference is made to the drawings. In the drawings, like reference numerals have been used throughout to designate like elements.

FIG. 1 depicts a block diagram of an aqueous printing system 100 that is configured to print images on coated paper without the energy consumption and elevated substrate temperatures that arise from additional dryers operating in the same manner as the first dryer. The system 100 includes a marking material module 102 having one or more arrays 104 of printheads, a substrate transport 106, a dryer 108, and a substrate cooling unit 112. The substrate transport 106 is implemented with an endless belt entrained about a pair of rollers, one of which is shown in the figure. One of the rollers is driven by an actuator, such as an electrical motor, to rotate the belt about the rollers. The printhead arrays 104 are operated in a known manner by a controller 120 to eject drops of aqueous ink onto the substrates passing by the arrays in a process direction to form ink images on the substrates. The term "process direction" as used in this document refers to the direction of substrate movement past the printheads and through the dryer that lies in the plane of the substrate. The substrate transport 106 delivers the printed substrates to the receiving end 220 of the dryer 108.

The dryer 108 is configured to dry a greater number of substrates than previously known dryers in aqueous ink printing systems and to heat the substrates to a temperature that is adequate to enable the aqueous ink on coated substrates to migrate from the surface of the substrates into the body of the substrates so they meet the touch criterion. To accomplish this goal, the dryer 108 is configured with grippers that capture an unprinted margin of printed substrates received from the marking unit and then transitions the substrates so they vertically hang without touching one another as they pass through the chamber to enable both planar surfaces of the substrates to be exposed to the heat and to increase the exposure time to the heat. As used in this document, the words "hang" or "hanging" refer to a substrate held at one end that is positioned at a higher gravitational potential than an opposite end of the substrate. The grippers in the dryer 108 can be nip roller pairs or clamps that secure an unprinted marginal area of each substrate, so the printed image is not disturbed and then the nip roller pairs or clamps follow a track to hang the substrates from the nip roller pair assemblies or clamps. The substrates are subjected to heat within the dryer until the nip roller pairs or clamps reach the end of the track where the substrates are delivered to the substrate cooler 112 in the printer and carried to an output tray. The increased exposure time to the heat in the dryer enables the temperature of the substrates to be elevated to a level that lowers the viscosity of the solvents in the substrates so they migrate away from the surfaces of the substrates into the bodies of the substrates. Thus, the ink image becomes tolerant to touch without subjecting the substrates to temperatures that could degrade the quality of the paper. The substrates can then be stacked in the output tray at temperatures that can be handled by a user.

With continued reference to FIG. 1, the dryer 108 includes a housing 204 and a track 208 on which nip roller pairs 212 travel in a continuous loop. As noted above, the grippers can be implemented with nip roller pairs or clamps. An embodiment that uses nip roller pairs is described with reference to FIG. 1, FIG. 2A, FIG. 2B, and FIG. 3. Drivers 216 are located at the receiving end 220 and the exit end 224 of the track 208 to engage one of the nip roller pairs 212 and capture a substrate at the receiving end 220 and to release the dried substrate from the nip roller pair at the exit end 224 so it can transition to the substrate transport 236 of the substrate cooler 112. A heater 240 supplies heat within the housing 204 of dryer 108 at a temperature that lowers the viscosity of the solvents in the ink to enable the migration of the solvents into the bodies of the substrates or to evaporate the solvents from the surfaces of the substrates. In one embodiment, the heater 240 includes an array of infrared lamps that generates infrared radiation in a range around 2 microns. In other embodiments, a convection heater or heating lamp can be used and the heated air produced by the heater is directed by a blower toward the substrates. To exhaust evaporated solvents and water vapor from the housing 204 an exhaust vent 244 is positioned in a ceiling of the housing 204. To aid in this exhausting of evaporated solvents and water vapor, a fan can be configured to communicate with the exhaust vent 244 to draw air from the housing 204. Additionally, a blower 248 can be positioned at the receiving end 220 to direct air toward the ink images on the substrates to ensure the ink images on the substrates being captured at the receiving end do not engage with surfaces within the housing 204 as the substrates transition to the track 208 as shown in FIG. 1.

Figure 2A:
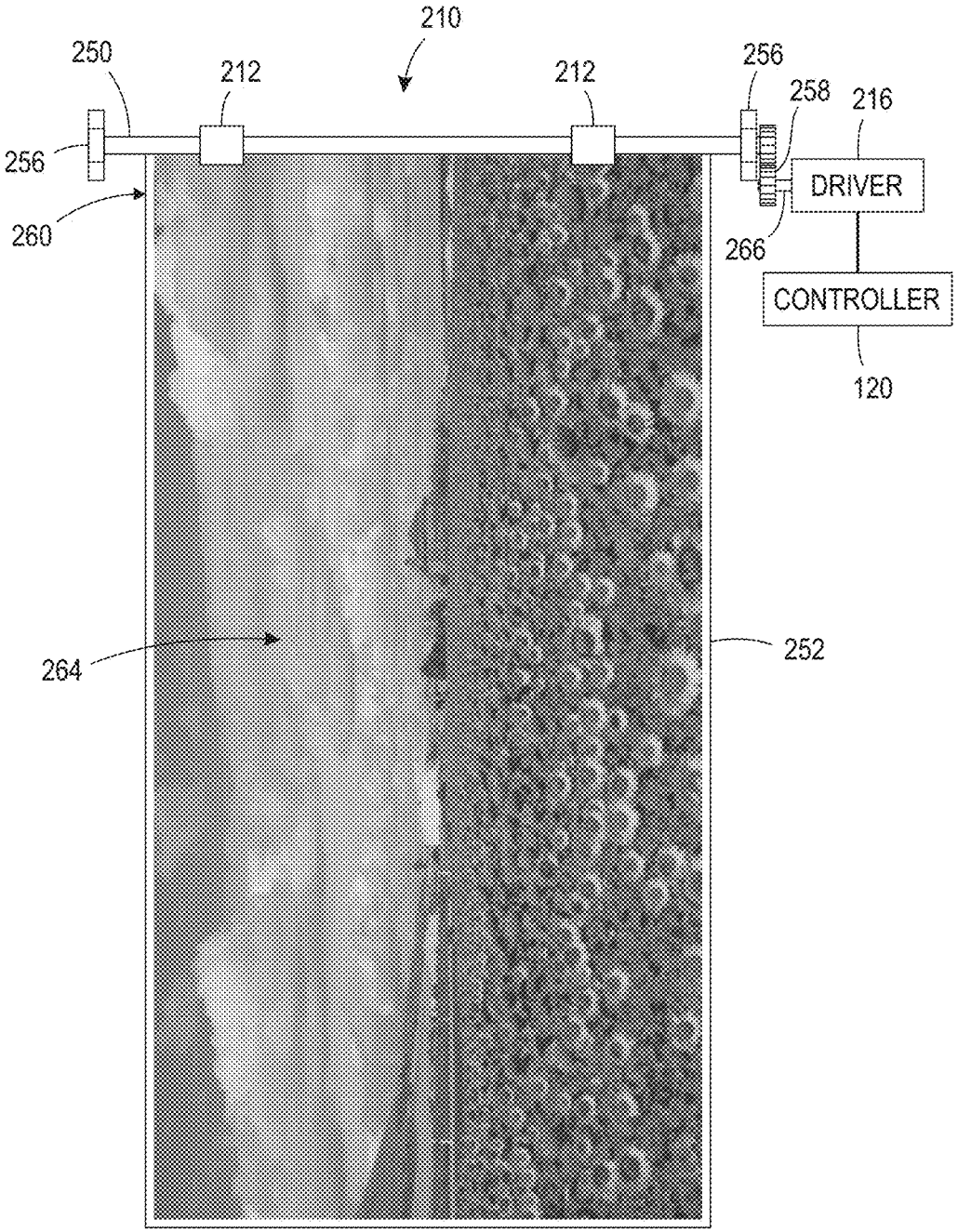
FIG. 2A illustrates in a frontal view, a configuration of the nip roller pairs in the printer of FIG. 1.
Figure 2B:
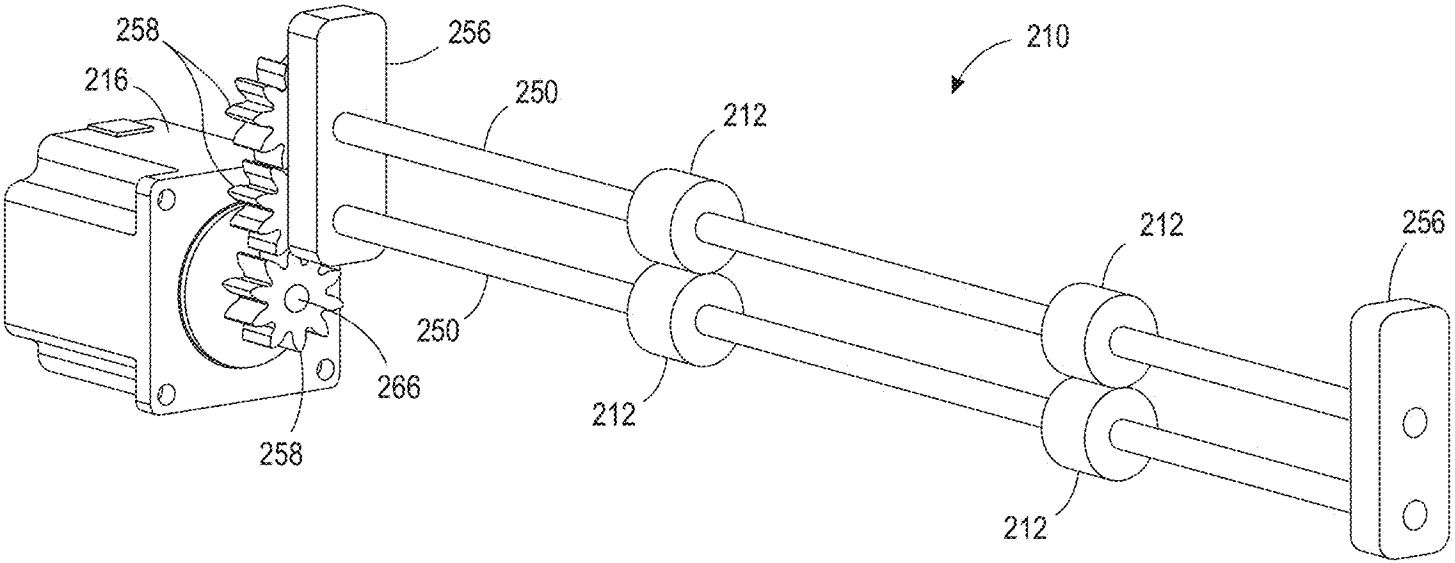
FIG. 2B illustrates a nip roller pair interfacing with the driver of FIG. 2A.

A configuration of a nip roller assembly 210 is shown from the front in FIG. 2A and in perspective in FIG. 2B. A pair of rollers 212 is mounted to each member 250. The rollers 212 contact the roller on the other member to form nips at positions that enable the nip roller pairs to contact a substrate 252 within the width of the substrate in the cross-process direction. FIG. 2A shows only one roller of each nip roller pair as the other member 250 and the two rollers 212 mounted to that roller are positioned behind the depicted member 250 and the rollers 212 mounted to it as well as being behind the substrate 252. The term "cross-process direction" as used in this document refers to the direction that is perpendicular to the process direction and in the plane of the substrate when the substrate is horizontal as it is on the substrate transport 106. The ends of each member 250 are mounted for rotation within brackets 256. The ends of the members 250 on the driven side of the members extend through the bracket 256 and a gear 258 is mounted on each one with the teeth of the gears interlocking with the teeth of the other gear. These gears 258 are configured with a one-way clutch to prevent the release of the substrates by the opposite rotation of the gears. The driver 216 has an output shaft 266 about which a gear 258 has been mounted. Rotation of the gear 258 on the output shaft 266 by the driver 216 also rotates the gears 258 mounted on the ends of the members 250. When a printed substrate arrives on the transport 106 (FIG. 1) at the receiving end 220 of the dryer 108, the leading edge of the substrate engages the two nips formed by the two nip roller pairs. The rotation of the gears 258 on the members 250 by the gear 258 and output shaft 266 of the driver 216 rotates the roller pairs 212 in both nip roller pairs in a direction that feeds the unprinted margin 260 of the leading edge of the printed image 264 on the substrate 252 firmly between the rollers in each roller pair 212. The controller 120 operates the driver 216 enough to capture this portion of the leading edge, but then stops the operation of the driver and then operates the drive for the track 208, which catches the brackets 256 and moves the nip roller pair assembly 210 away from the driver 216 and the one-way clutch prevents the rollers from rotating in the opposite direction, which would release the substrate. After traversing the track 208 and reaching the exit end 224, the controller 120 operates another driver 216 to rotate its output shaft 266 and the gear 258 mounted to the shaft to drive the gears 258 at the driven ends of the members 250 so the nip roller pairs 212 rotate to feed the substrate bearing the now-dried printed image through the nips between the roller pairs to propel the substrate into another pair of nip rollers 228 (FIG. 1 and FIG. 3), one of which is driven by another actuator 270 also operated by the controller 120 to push the substrate through an exit slot 232 in the housing 204 into a series of driven nip rollers that form the substrate transport 236 (FIG. 1). In one embodiment, the drivers 216 and 270 are electrical motors.

Figure 3:
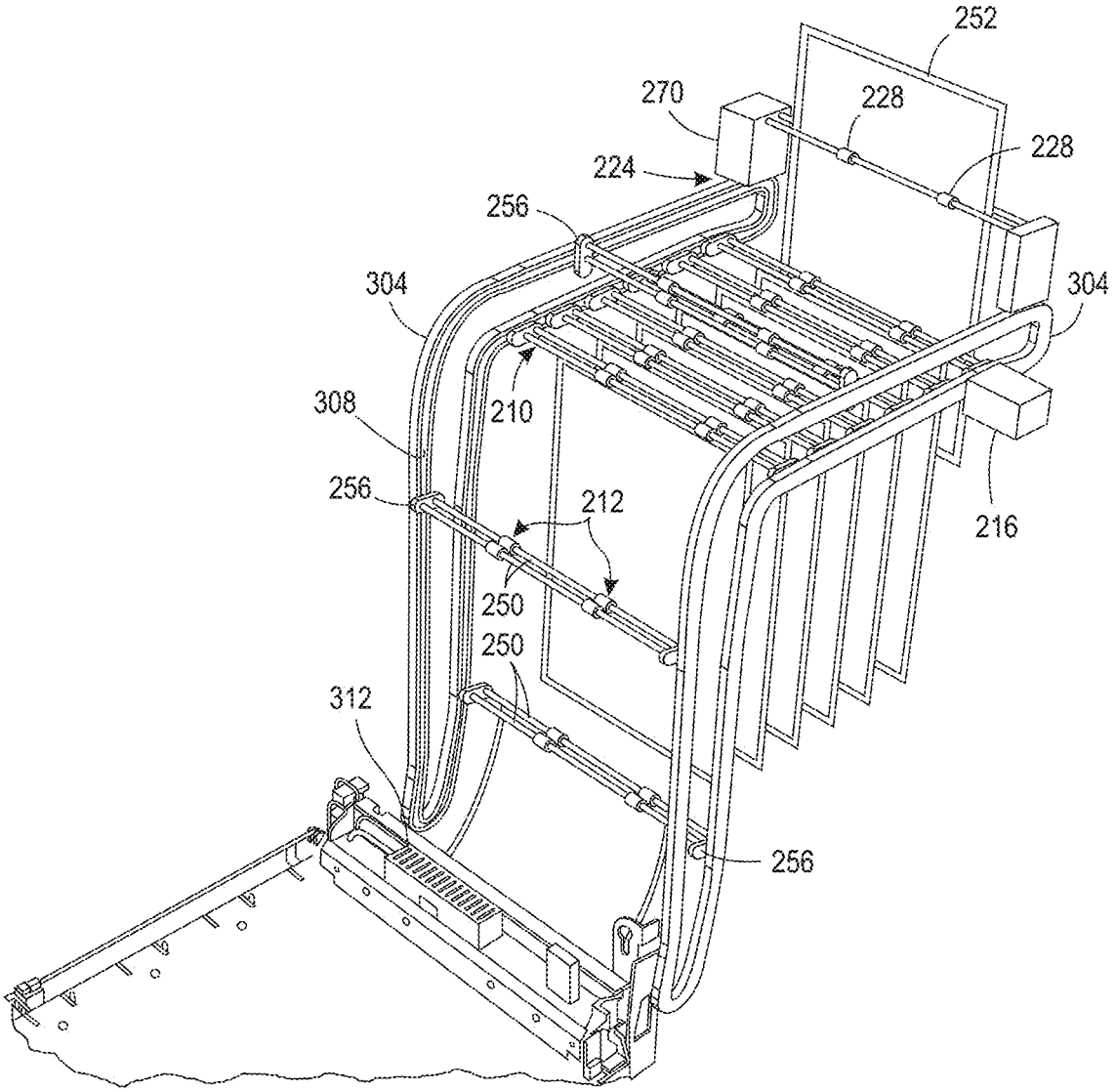
FIG. 3 is a perspective view of the track and gripper configuration in the printer of FIG. 1.

FIG. 3 depicts the track 208 and the members 250 of FIG. 1 without the housing 204 to simplify the view. The track 208 has two roughly L-shaped members 304 that have a channel 308 in each one. An endless member is within each channel 308 of each member 304 and this endless member has couplers at predetermined intervals for hooking the brackets 256 of the members 250. An actuator 312 is operatively connected to the endless member to move the endless member within the members 304. The controller 120 is operatively connected to the actuator 312 to operate the actuator selectively to move the endless member and the members 250 coupled to the endless member along the track 208. When a pair of members 250 in a nip roller assembly 210 carrying nip rollers 212 reaches the lower horizontal portion of the members 304, the couplers on the endless belt release the brackets 256 and the assembly 210 falls to push the currently last nip assembly 210 toward the exit end 224. On this horizontal portion of the members 304, the substrates 252 hang within the heated air of the dryer 108. When a nip roller assembly 210 reaches the exit end 224, the driver 216 engages the gears 258 at the ends of the members 250 adjacent the driver 216. As the driver 216 rotates the gears 258 and the members 250, the substrate 252 is propelled into the nip roller pair 228, which is driven by the actuator 270, for removal of the substrate and the dried printed image from the dryer 108. Once the substrate is released, a coupler on the endless belt engages the brackets 256 to carry the empty nip roller assembly 210 up to the upper horizontal section and then down the vertical section of the L-shaped members 304 until the nip assembly 210 returns to the entrance 220. There the nip roller assembly 210 waits until another substrate is presented for capture of the leading edge.

The advantage of the dryer 108 that transitions the substrates from the horizontal position in which they are printed to the non-touching hanging orientation in which they are dried is the reduced distance for the drying path. As used in this document, the term "horizontal" means the ends of the substrate as it moves in the process direction are at approximately the same gravitational potential. As shown in FIG. 1, eight substrates are within the housing 204 at a time. If each of these substrates is two feet in length, then the dryer 108 would need to be over sixteen feet in length to house the eight substrates and the gaps between adjacent substrates horizontally. At a typical substrate speed of approximately 850 mm/sec, a substrate in a linear horizontal dryer path would be exposed to heat for 5.7 seconds. By hanging the substrates in the dryer 108, adjacent vertical substrates require about half of the four feet necessary to accommodate two adjacent sheets oriented horizontally and all of the surfaces of the substrate are exposed to the heat of the dryer. Therefore, the speed at which the nip roller pairs move along the track can be substantially reduced to obtain the 5.7 seconds of heat exposure within the much reduced footprint of the housing 204. As described above with regard to FIG. 3, the actuator that drives the endless belt in track 208 is connected to controller 120. The controller 120 is configured with programmed instructions stored in a memory operatively connected to the controller. The controller 120 executes the programmed instructions with reference to data stored in the memory and received from sensors in the printer to regulate the speed of the nip roller pairs and clamps along the track 208 and to synchronize the capture and release of the substrates from the nip roller assemblies moving along the members 304. Parameters regarding the weight, size, thickness, and the like of the substrates can be entered into a user interface connected to the controller or detected upon the loading of the unprinted substrates into the printer. The controller 120 then regulates the speed at which the substrates move through the dryer 108 to optimize the time spent in the dryer for making the ink image on the substrates touch tolerant.

Figure 4:
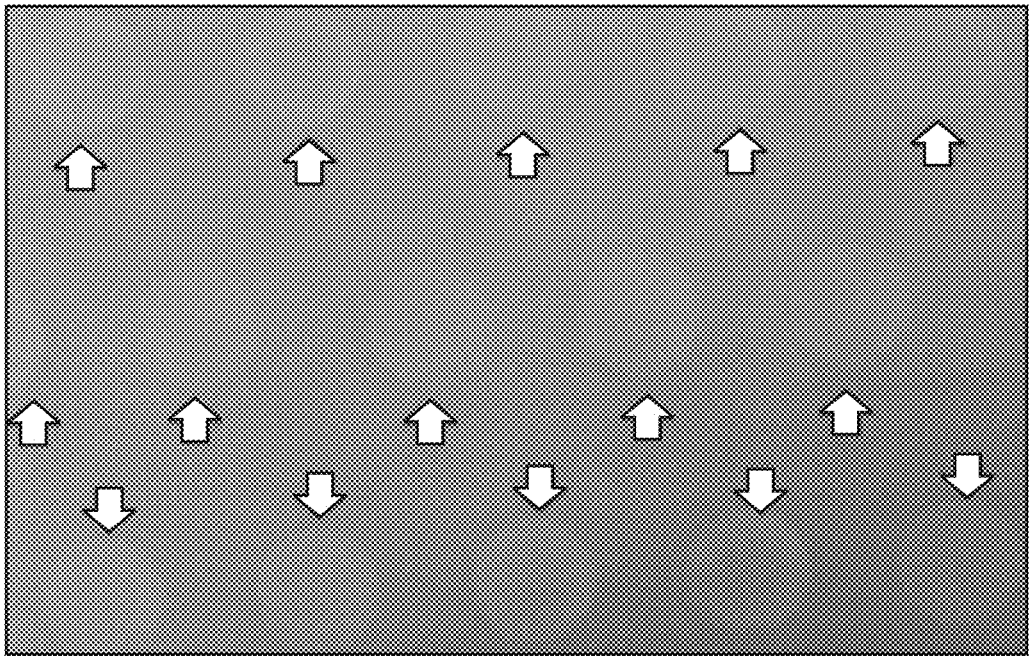
FIG. 4 depicts an artifact produced in drying substrates printed with aqueous ink images on solid transport belts having holes configured to enable air pressure to hold the substrates to the belt.

Another advantage of the dryer shown in FIG. 1 is the elimination of differential drying of the substrates. Differential drying of substrates through previously known dryers is caused by holes in the transport belt that supports the horizontal substrates as they pass through the dryer. The transport belt is positioned between a source of negative air pressure and the substrates carried by the belt so air can be pulled by the negative air pressure through the substrates and the holes in the belt to produce a pressure that helps hold the substrates against the transport belt. The air flow through the portions of the substrates aligned with the holes in the transport belt keeps those portions cooler than the areas that lie against solid areas of the transport belt. These cooler areas do not evaporate as much water and solvent as the warmer areas adjacent the solid belt areas. This temperature differential produces artifacts in the ink image to which the arrows in FIG. 4 are pointing. By eliminating the need for a transport belt in the dryer 108, the dryer shown in FIG. 1 enables more uniform drying to occur across the surface of the substrates so the artifacts caused by differential drying are not produced.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An aqueous ink printer comprising:
   - at least one printhead configured to eject drops of an aqueous ink onto substrates moving past the at least one printhead to form ink images on the substrates; and
   - a dryer configured to hang the substrates vertically without the hanging substrates touching one another as heat is applied to the substrates within the dryer.

2. The aqueous ink printer of claim 1, the dryer further comprising:
   - a housing;
   - a track located within the housing;
   - a plurality of grippers positioned at intervals along the track and the plurality of grippers being configured to move along the track, each gripper being configured to capture at a first predetermined position on the track a portion of one of the substrates in an area outside of the ink image on the one substrate and to release the one substrate at a second predetermined position on the track, the track and the grippers being further configured to hang the substrates held by the grippers vertically within the housing; and
   - a heater configured to generate heat within the housing to dry the hanging substrates held by the grippers as the grippers move along the track.

3. The aqueous ink printer of claim 2, the heater further comprising:
   - a plurality of heating elements.

4. The aqueous ink printer of claim 3 wherein each heating element is an infrared radiator.

5. The aqueous ink printer of claim 3 wherein each heating element is a microwave radiator.

6. The aqueous ink printer of claim 3 wherein each heating element is a heat lamp.

7. The aqueous ink printer of claim 3 wherein the housing has a vent opening to enable evaporated water and solvent to exit the housing.

8. The aqueous ink printer of claim 7, the dryer further comprising:
   - a source of negative air pressure fluidically connected to the vent opening to pull air from within the housing.

9. The aqueous ink printer of claim 2 wherein the heater is a convection heater.

10. The aqueous ink printer of claim 2 wherein each gripper is a nip roller pair.

11. The aqueous ink printer of claim 2 wherein each gripper is a clamp.

12. The aqueous ink printer of claim 1 further comprising:

an actuator operatively connected to the plurality of grippers, the actuator being configured to move the plurality of grippers along the track; and a controller operatively connected to the actuator, the controller being configured to operate the actuator with reference to substrate parameters to regulate a speed of the plurality of grippers along the track.

13. The dryer of claim 1 further comprising:

an actuator operatively connected to the plurality of grippers, the actuator being configured to move the plurality of grippers along the track; and a controller operatively connected to the actuator, the controller being configured to operate the actuator with reference to substrate parameters to regulate a speed of the plurality of grippers along the track.

14. A dryer for an aqueous ink printer comprising:

a housing;

a track located within the housing;

a plurality of grippers positioned along the track and the plurality of grippers being configured to move along the track, each gripper being configured to capture at a first predetermined position on the track a portion of a substrate bearing an ink image in an area outside of the ink image on the substrate and to release the substrate at a second predetermined position on the track, the track and the grippers being further configured to hang the substrates held by the grippers vertically within the housing without the hanging substrates touching one another; and a heater configured to generate heat within the housing to dry the hanging substrates held by the grippers as the grippers move along the track.

15. The dryer of claim 14, the heater further comprising:

a plurality of heating elements.

16. The dryer of claim 15 wherein each heating element is an infrared radiator.

17. The dryer of claim 15 wherein each heating element is a microwave radiator.

18. The dryer of claim 15 wherein each heating element is a heat lamp.

19. The dryer of claim 15 wherein the housing has a vent opening to enable evaporated water and solvent to exit the housing.

20. The dryer of claim 19, the dryer further comprising:

a source of negative air pressure fluidically connected to the vent opening to pull air from within the housing.

21. The dryer of claim 14 wherein the heater is a convection heater.

22. The dryer of claim 14 wherein each gripper is a nip roller pair.

23. The dryer of claim 14 wherein each gripper is a clamp.

* * * * *